US008777079B2

(12) United States Patent
Po et al.

(10) Patent No.: US 8,777,079 B2
(45) Date of Patent: Jul. 15, 2014

(54) NAIL GUN CAPABLE OF PREVENTING ITS TRIGGER FROM BEING PULLED IN NAIL-EMPTY CONDITION

(75) Inventors: Chien-Kuo Po, Taichung (TW); Kun-Ta Wu, Taichung (TW)

(73) Assignee: Basso Industry Corp., Taichung (TW)

( * ) Notice: Subject to any disclaimer, the term of this patent is extended or adjusted under 35 U.S.C. 154(b) by 180 days.

(21) Appl. No.: 13/047,087

(22) Filed: Mar. 14, 2011

(65) Prior Publication Data

US 2011/0240710 A1 Oct. 6, 2011

(30) Foreign Application Priority Data

Mar. 30, 2010 (TW) ..... 99109677 A

(51) Int. Cl.
*B25C 1/04* (2006.01)

(52) U.S. Cl.
USPC ..... 227/8; 227/130

(58) Field of Classification Search
USPC ..... 227/8, 120, 121, 125, 127, 135, 136, 227/156
See application file for complete search history.

(56) References Cited

U.S. PATENT DOCUMENTS

| | | | | |
|---|---|---|---|---|
| 6,908,021 | B1 | 6/2005 | Wang | |
| 7,032,794 | B1 * | 4/2006 | Hung et al. | 227/8 |
| 7,303,103 | B2 * | 12/2007 | Wang | 227/8 |
| 7,413,103 | B1 * | 8/2008 | Ho et al. | 227/8 |
| 2005/0121488 | A1 * | 6/2005 | Sun | 227/109 |

* cited by examiner

*Primary Examiner* — Thanh Truong
*Assistant Examiner* — Nathaniel Chukwurah
(74) *Attorney, Agent, or Firm* — Browdy and Neimark, PLLC

(57) ABSTRACT

A nail gun includes a rotatable shaft which can lock a switch of a trigger of the nail gun in a nail-empty condition. The rotatable shaft has a locking portion and a driven portion extending partly into a nail magazine, such that when a nail pushing member disposed in the nail magazine reaches a predetermined position, the nail pushing member pushes the driven portion to make the rotatable shaft rotate about an axis perpendicular to a marching direction of the nails loaded in the nail magazine. As a result, the locking portion of the rotatable shaft in an initial position and spaced away from the switch will move to a locking position to be engaged with the switch. Therefore, the nail gun can shoot nails continuously until there is totally no nail in the nail gun and the nail gun is locked.

8 Claims, 5 Drawing Sheets

NAIL GUN CAPABLE OF PREVENTING ITS TRIGGER FROM BEING PULLED IN NAIL-EMPTY CONDITION

BACKGROUND OF THE INVENTION

1. Field of the Invention

The present invention relates generally to nail guns and more particularly, to a nail gun capable of preventing its trigger from being pulled in a nail-empty condition where there isn't any nail in the nail magazine and the muzzle of the nail gun.

2. Description of the Related Art

When people use nail guns, they usually need to shoot nails continuously. Therefore, when there is no nail in a nail magazine and a muzzle of a nail gun, people may still pull a trigger of the nail gun for one time, or even for several more times in order to confirm that there is indeed no nail in the nail gun. However, aforesaid habitual action may damage some firing elements of the nail gun so as to decrease the lifetime of the nail gun. As a result, some enterprises start to design nail guns which can prevent their triggers from being pulled in a nail-empty condition.

For example, U.S. Pat. No. 6,908,021 disclosed a nail gun having a structure for preventing the nail gun from being fired with no nail therein, which comprises a rotatable shaft disposed on one side of a nail magazine of the nail gun, a driven piece attached to a front end of the rotatable shaft, and a locking piece extending from a rear end of the rotatable shaft toward a trigger of the nail gun. The driven piece penetrates through a side wall of the nail magazine and is stopped against a nail in the nail magazine in normal conditions. After the nails in the nail magazine are shot to a certain extent, there will be no nail to be abutted by the driven piece. At this moment, the driven piece will move inward the nail magazine and make the rotatable shaft rotate about an axis parallel to the marching direction of the nails so as to make the locking piece move toward the trigger. As a result, the locking piece will lock the trigger so that the nail gun can't be fired any more. At this moment, however, there is still at least one nail in a muzzle of the nail gun, which can be shot only if the user turns the rotatable shaft manually to move the locking piece away from the trigger, and that is very inconvenient.

Besides, in the above-mentioned design, the aforesaid locking piece is stopped right behind the trigger to prohibit the trigger from movement when the trigger is pulled; therefore, the locking effect thereof may decrease when the trigger is a little bit deformed due to a long time or improper use. As a result, the locking piece may loosen while receiving the vibration of firing, or even totally lose its function of preventing the trigger from being pulled in a nail-empty condition.

Furthermore, Taiwan Patent No. M369230 disclosed a nail gun having a safety sliding shaft which can be moved by a nail pushing member in the nail magazine to prevent the nail gun from being fired with no nail therein. Although the nail gun can solve above-mentioned problem, the structure of the nail gun is complicated to need improvement.

SUMMARY OF THE INVENTION

The present invention has been accomplished in view of the above-noted circumstances. It is an objective of the present invention to provide a nail gun capable of preventing its trigger from being pulled in a nail-empty condition, which is simple in structure and can be fired continuously until there is no nail in the nail gun.

It is another objective of the present invention to provide a nail gun capable of preventing its trigger from being pulled in a nail-empty condition, which is easy in use and has a longer lifetime.

To attain the above objectives, the present invention provides a nail gun capable of preventing its trigger from being pulled in a nail-empty condition, which comprises a housing connected with a muzzle, a trigger having a switch for firing a nail in the muzzle, and a nail magazine communicated with the muzzle for accommodating nails and a nail pushing member for pushing the nails toward the muzzle. The nail gun is characterized in further comprising a rotatable shaft and a pusher. The rotatable shaft, which is disposed at one side of the nail magazine in such a way that the rotatable shaft is rotatable about an axis perpendicular to a marching direction of the nails, has a locking portion and a driven portion having a part penetrating through a side wall of the nail magazine into an inside of the nail magazine. The pusher is attached to the nail pushing member for turning the rotatable shaft by pushing the driven portion of the rotatable shaft to make the locking portion of the rotatable shaft lock the switch of the trigger. As a result, the nail pushing member can move to a predetermined position right after the last nail in the nail gun is shot, and then make the pusher push the driven portion of the rotatable shaft to make the locking portion of the rotatable shaft move to a locking position so that the trigger can't be pulled.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
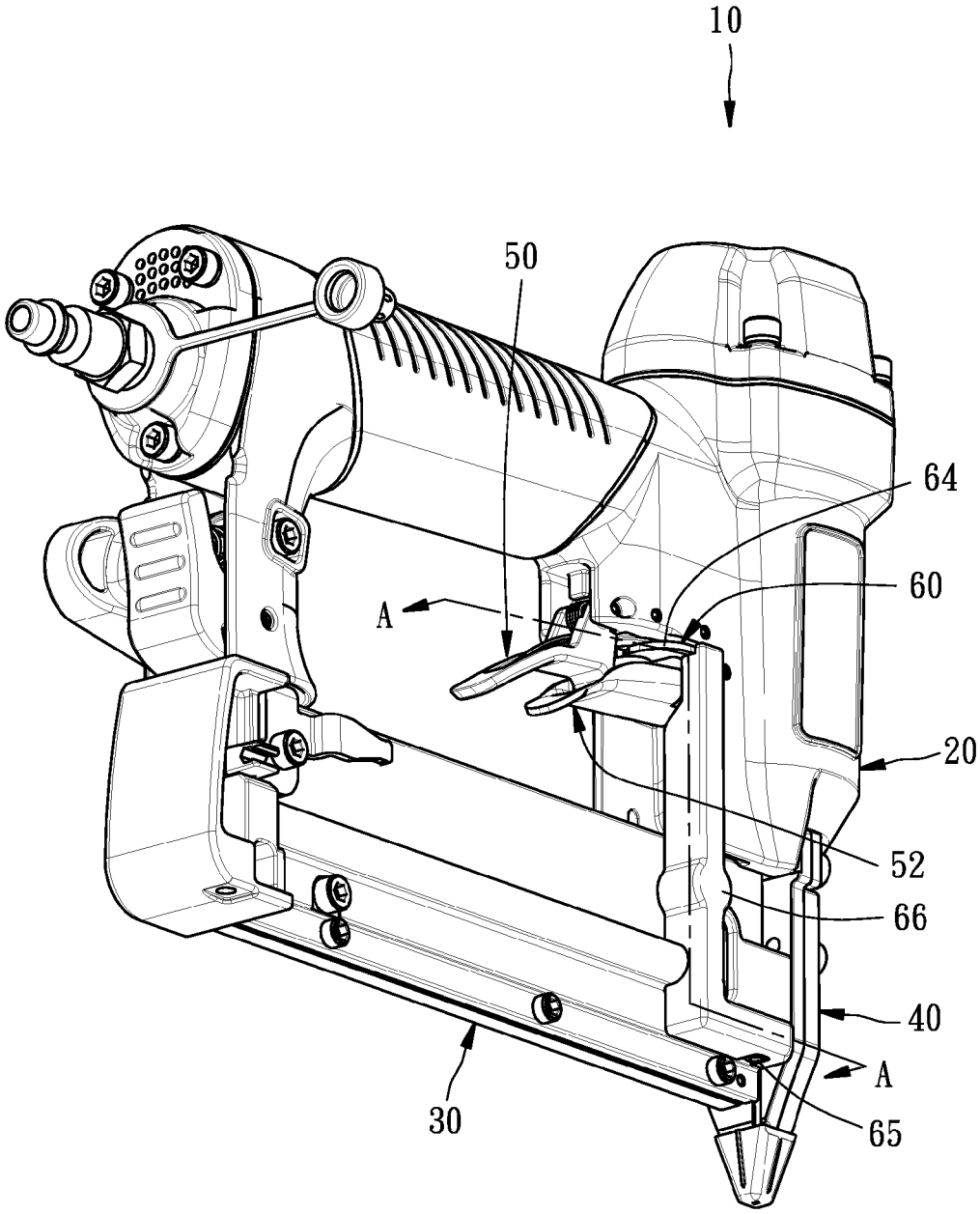
FIG. 1 is an assembled perspective view of a nail gun according to a preferred embodiment of the present invention.
Figure 2:
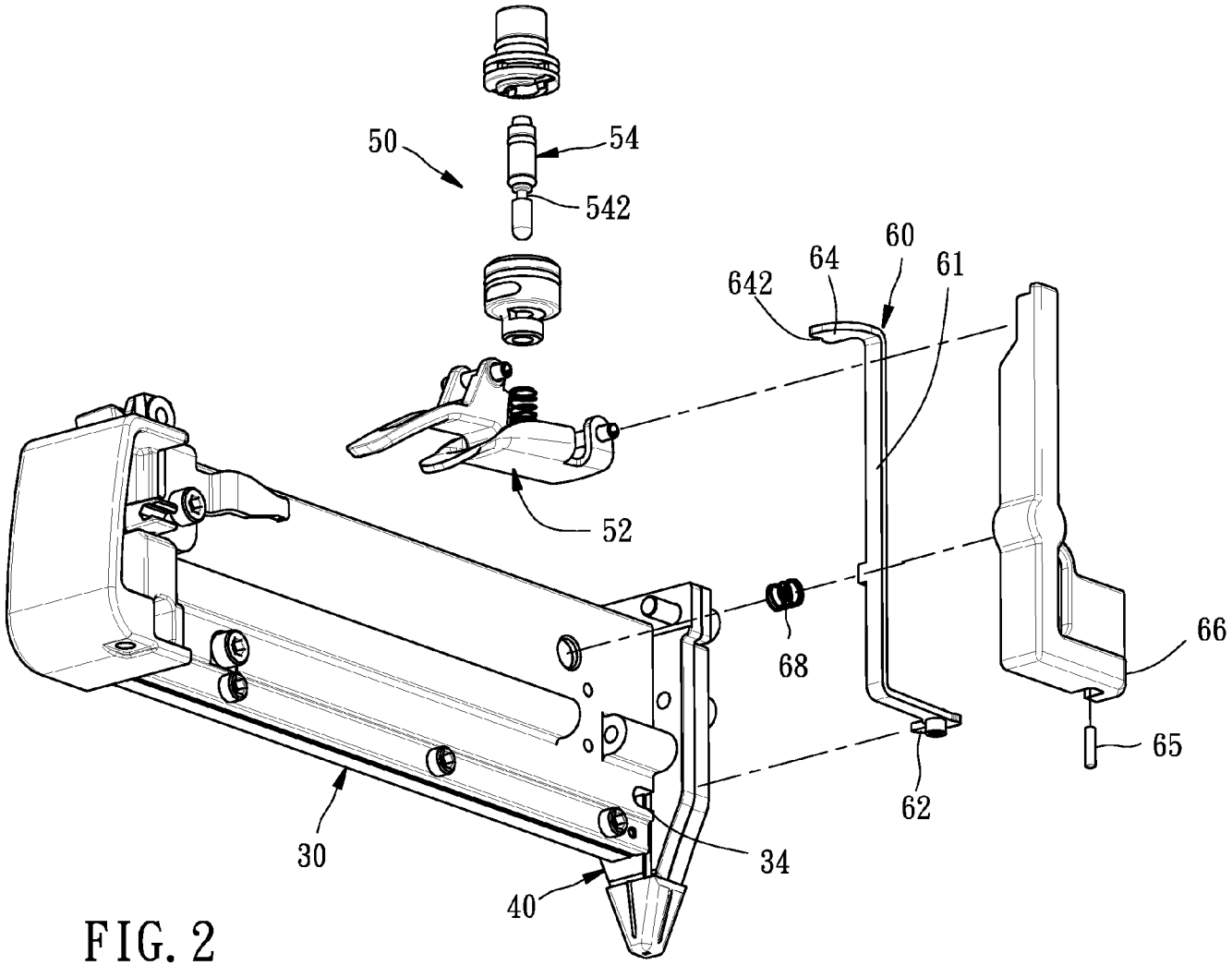
FIG. 2 is an exploded perspective view showing a nail magazine, a rotatable shaft and a trigger of the nail gun of FIG. 1.
Figure 3:
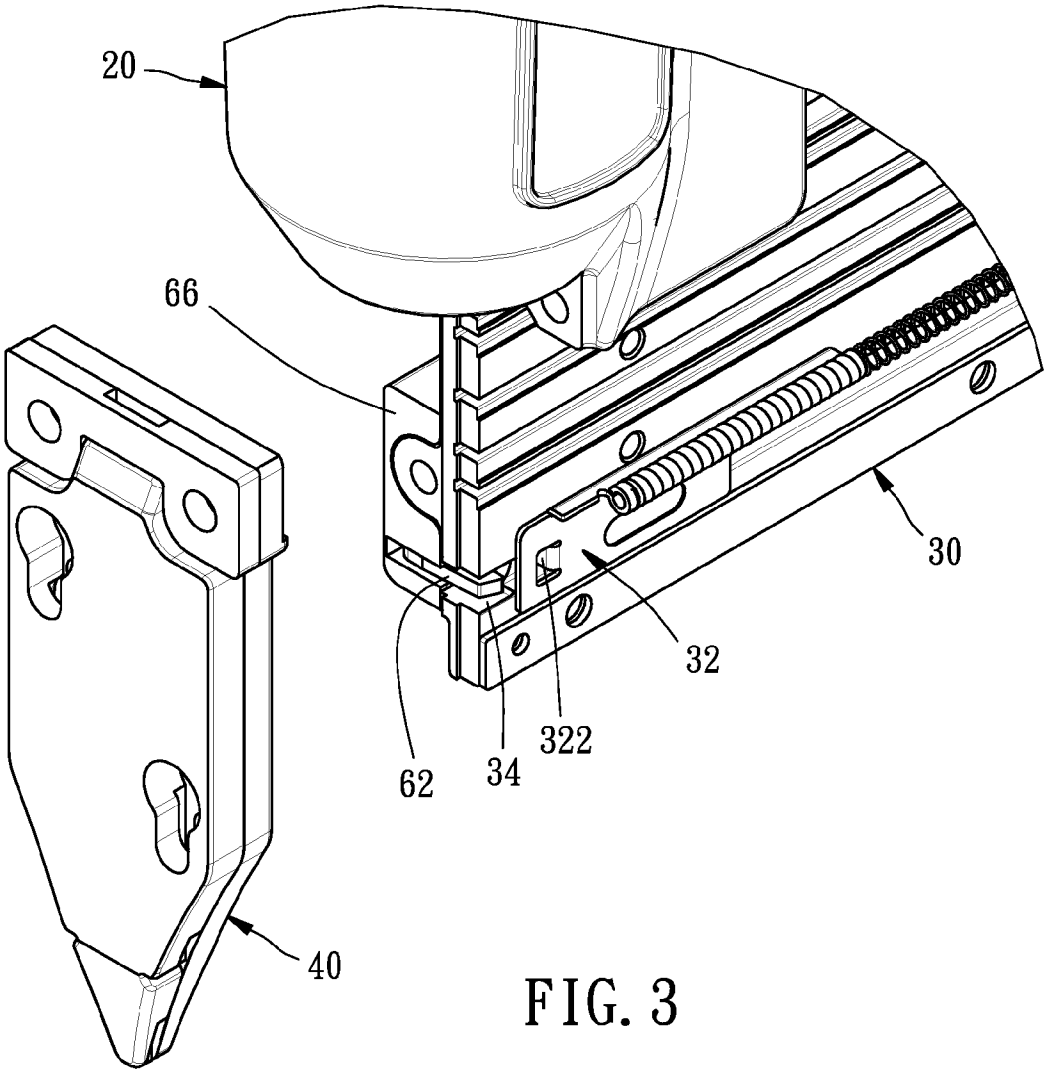
FIG. 3 is an exploded perspective view showing the inside structure of the nail magazine.

As shown in FIGS. 1-3, a nail gun 10, which is provided by a preferred embodiment of the present invention, comprises a housing 20, a nail magazine 30, a muzzle 40, a trigger 50, and a rotatable shaft 60.

The nail magazine 30 is connected with the housing 20 and has a space for accommodating a strip of nails (not shown), and a nail pushing member 32. The nails are connected one by one in an alignment manner, and the nail pushing member 32 is adapted to push the nails toward the front end of the nail magazine 30. The nail magazine 30 is provided with a side wall having a through hole 34 near the front end of the nail magazine 30. The front part of the nail pushing member 32 is integrally connected with a pusher 322 which extends from the nail pushing member 32 toward the side wall with the through hole 34 and can move forward and backward in the nail magazine 30 along with the nail pushing member 32.

The muzzle 40 is connected with the housing 20 and the front end of the nail magazine 30 in communication with the space of the nail magazine 30 for accommodating a to-be-shot nail. After the nail in the muzzle 40 is shot, the nail pushing member 32 will push the nails in the nail magazine 30 toward the muzzle 40 to supply another to-be-shot nail into the muzzle 40.

The trigger 50 is installed at about the middle part of the housing 20 and has a pressable member 52 exposed most outside for a user to press thereon so as to fire the nail gun 10. The pressable member 52 can be pressed to click a switch 54 of the trigger 50 to activate a firing device (not shown) inside the housing 20 so as to shoot the nail in the muzzle 40 out of the muzzle 40. Besides, as shown in FIG. 2, the switch 54 includes a driving shaft which has an annular groove 542.

The rotatable shaft 60 has an L-shaped body portion 61, a driven portion 62 shaped like a short stick extending integrally from an end of the body portion 61, and a locking portion 64 shaped like a plate extending integrally from another end of the body portion 61. The rotatable shaft 60 is attached to the side wall of the nail magazine 30 that has the hole 34, in such a way that the driven portion 62 penetrates through the through hole 34 so that the driven portion 62 of the rotatable shaft 60 is inserted inside the nail magazine 30 partly. The locking portion 64 has a concavity 642 concaved inward from the circumference of the locking portion 64 and having an opening which faces the groove 542 of the switch 54. The rotatable shaft 60 is penetrated by a pivot 65 at a place where the body portion 61 intersects with the driven portion 62, and the pivot 65 extends perpendicular to the marching direction of the nails. Therefore, the rotatable shaft 60 can be rotatably connected with a fixed member 66 by the pivot 65. The fixed member 66 is a shell covering the rotatable shaft 60, connecting with the pressable member 52 of the trigger 50, and being fixed relative to the nail magazine 30. As a result, the rotatable shaft 60 can rotate relative to the nail magazine 30 about an axis perpendicular to the marching direction of the nails, i.e. the axis of the pivot 65.

Figure 4:
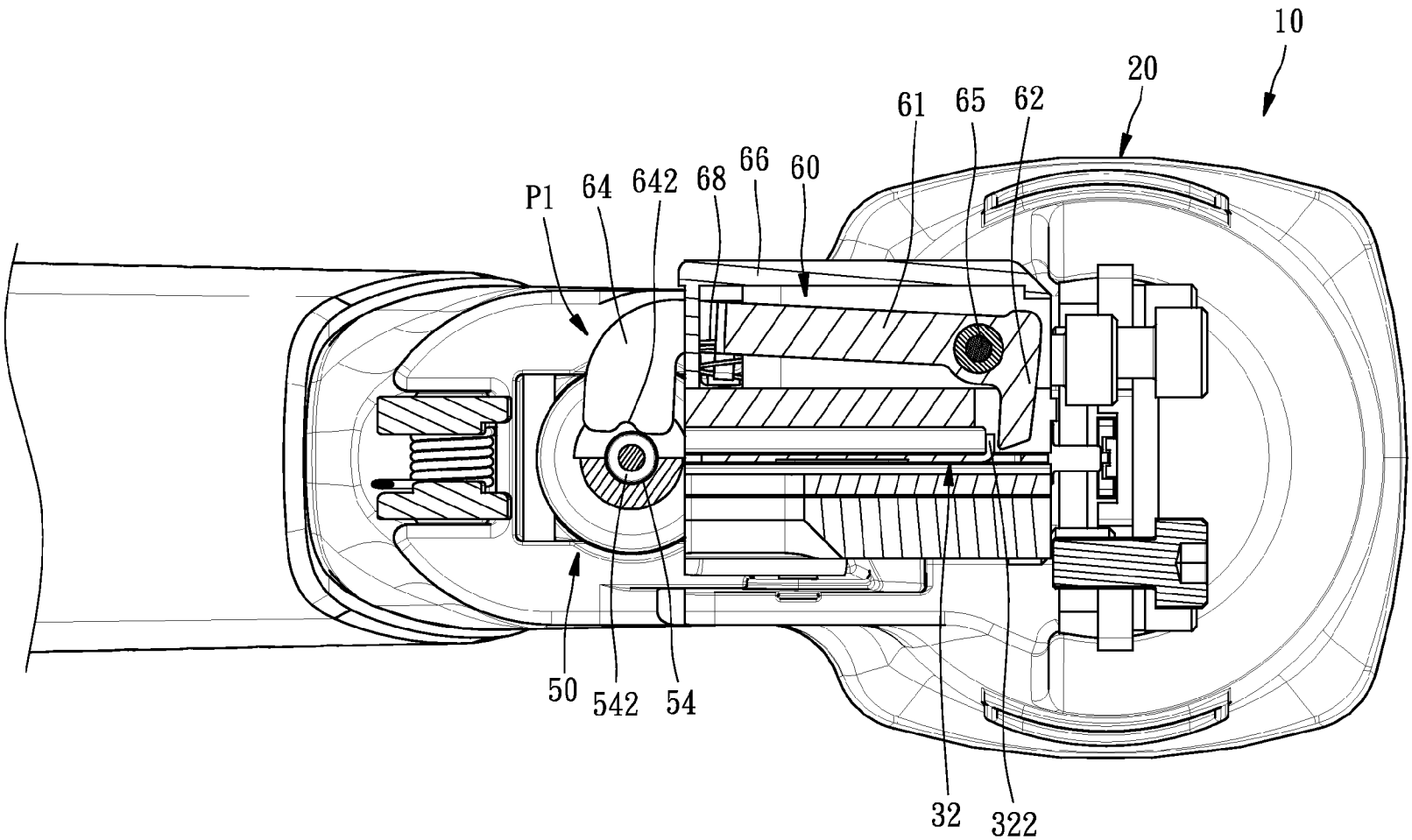
FIG. 4 is a sectional view taken along line A-A of FIG. 1 and showing that a locking portion of the rotatable shaft is in an initial position.
Figure 5:
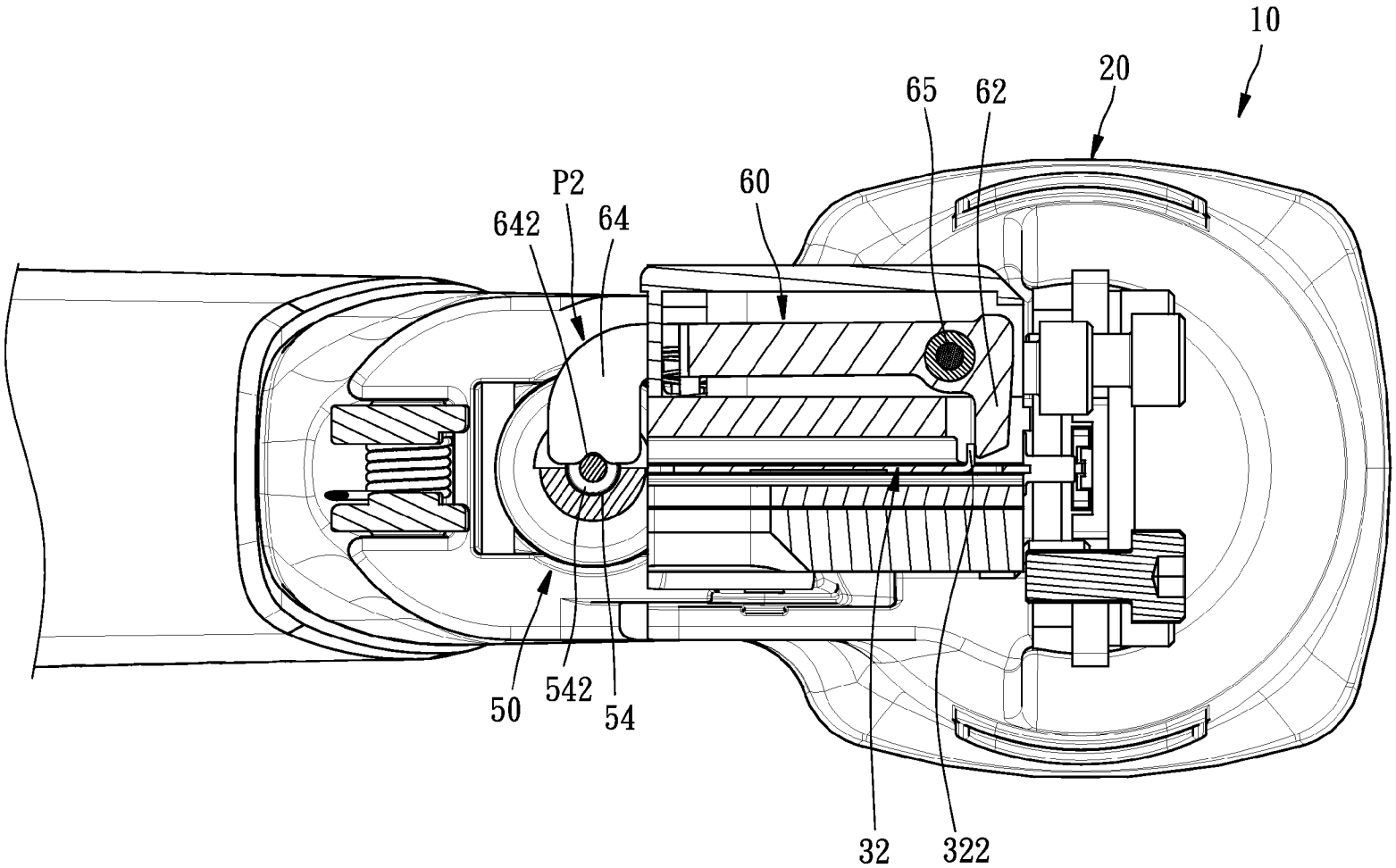
FIG. 5 is similar to FIG. 4 but showing that the locking portion of the rotatable shaft is in a locking position.

When aforesaid nail gun 10 is in a fireable condition where there is at least a nail in the nail magazine 30 or the muzzle 40, the locking portion 64 of the rotatable shaft 60 is kept in an initial position P1 by the support of a resilient member 68 which is stopped between the middle part of the body portion 61 of the rotatable shaft 60 and the nail magazine 30. As shown in FIG. 4, the locking portion 64 of the rotatable shaft 60 in the initial position P1 is spaced away from the trigger 50. When there is no nail in the nail magazine 30 and the last nail in the muzzle 40 is shot, the nail pushing member 32 will move toward the front end of the nail magazine 30 to a predetermined position to make the pusher 322 push the driven portion 62 of the rotatable shaft 60 so as to turn the rotatable shaft 60 and make the locking portion 64 move to a locking position P2, as shown in FIG. 5. At this moment, the concavity 642 of the locking portion 64 is engaged with the groove 542 of the switch 54 so that the user can't press the pressable member 52 to click the switch 54, which means the trigger 50 can't be pulled. After that, as long as nails are reloaded into the nail magazine 30 to push the nail pushing member 32 to move toward the rear end of the nail magazine 30, the pusher 322 of the nail pushing member 32 will separate from the driven portion 62 of the rotatable shaft 60 and the rebound force of the resilient member 68 will turn the rotatable shaft 60 reversely. As a result, the locking portion 64 will move back to the initial position P1 so that the switch 54 of the trigger 50 can be clicked again, and the nail gun 10 returns to the fireable condition.

It will be appreciated that the nail gun 10 provided in present invention is stable and durable because the way the rotatable shaft 60 locks the trigger 50 is that the concavity 642 of the locking portion 64 is engaged with the switch 54 of the trigger 50, and therefore the locking effect thereof will not decrease even if the trigger 50 is deformed due to a long time or improper use.

According to above-mentioned contents, the nail gun 10 provided in present invention can not only very conveniently shoot nails continuously until there is no nail in the nail gun 10, but also prevent the trigger 50 from being pulled in a nail-empty condition so as to prevent the nail gun 10 from being damaged.

The invention being thus described, it will be obvious that the same may be varied in many ways. Such variations are not to be regarded as a departure from the spirit and scope of the invention, and all such modifications as would be obvious to claims. one skilled in the art are intended to be included within the scope of the following

What is claimed is:

1. A nail gun capable of preventing a trigger from being pulled in a nail-empty condition, comprising:

a housing connected with a muzzle;

a trigger having a switch for firing a nail in the muzzle;

a nail magazine communicated with the muzzle for accommodating nails and a nail pushing member for pushing the nails toward the muzzle;

a rotatable shaft disposed at one side of the nail magazine in a way that the rotatable shaft is rotatable about an axis perpendicular to a marching direction of the nails, the rotatable shaft having a locking portion and a driven portion having a part penetrating through a side wall of the nail magazine into an inside of the nail magazine; and a pusher extending toward the side wall of the nail magazine from the nail pushing member for turning the rotatable shaft by pushing the driven portion of the rotatable shaft to make the locking portion of the rotatable shaft lock the switch of the trigger.

2. The nail gun as claimed in claim 1, further comprising a resilient member stopped against the rotatable shaft for providing a rebound force making the locking portion of the rotatable shaft move back to an initial position.

3. The nail gun as claimed in claim 1, wherein the locking portion of the rotatable shaft has a concavity, and the switch of the trigger has a groove which is engaged with the concavity of the locking portion when the locking portion is in a locking position.

4. The nail gun as claimed in claim 1, wherein the rotatable shaft has a body portion, and the driven portion and the locking portion extend integrally from two ends of the body portion respectively.

5. The nail gun as claimed in claim 1, wherein the rotatable shaft is rotatably connected with a fixed member which is fixed relative to the nail magazine so that the rotatable shaft is rotatable relative to the nail magazine.

6. The nail gun as claimed in claim 5, wherein the rotatable shaft is mounted with a pivot, which is perpendicular to the marching direction of the nails and by which the rotatable shaft is rotatably connected with the fixed member so that the rotatable shaft is rotatable about the axis perpendicular to the marching direction of the nails.

7. The nail gun as claimed in claim 1, wherein the rotatable shaft is mounted with a pivot, which is perpendicular to the marching direction of the nails and parallel to the firing direction of the nails.

8. The nail gun as claimed in claim 1, wherein the pusher pushes the driven portion of the rotatable shaft when there is no nail in the nail magazine and the last nail in the muzzle is shot.

* * * * *